US005544596A

United States Patent [19]

Brännström

[11] Patent Number: 5,544,596

[45] Date of Patent: Aug. 13, 1996

[54] METHOD OF SUPPLYING COAL AND SULPHUR ABSORBENT TO A COMBUSTOR AND A POWER PLANT IN WHICH THE METHOD IS APPLIED

[75] Inventor: Roine Brännström, Finspong, Sweden

[73] Assignee: ABB Stal AB, Finspong, Sweden

[21] Appl. No.: 300,200

[22] Filed: Sep. 2, 1994

Related U.S. Application Data

[63] Continuation of Ser. No. 917,069, filed as PCT/SE91/00063, Jan. 29, 1991 published as WO91/11659, Aug. 8, 1991.

[30] Foreign Application Priority Data

Feb. 1, 1990 [SE] Sweden ..... 9000354

[51] Int. Cl.[6] ..... F23K 1/00

[52] U.S. Cl. ..... 110/106; 122/40; 110/263; 110/264; 110/265; 110/245; 110/238

[58] Field of Search ..... 122/40; 110/263, 110/264, 265, 106, 245, 238

[56] References Cited

U.S. PATENT DOCUMENTS

| | | | |
|---|---|---|---|
| 4,259,911 | 4/1981 | Jones | 110/245 |
| 4,434,726 | 3/1984 | Jones | 110/245 |
| 4,628,833 | 12/1986 | O'Hagan et al. | 110/245 |
| 4,630,556 | 12/1986 | Scheffee | 110/238 |
| 4,776,288 | 10/1988 | Beisswenger et al. | 110/245 |
| 4,815,418 | 3/1989 | Maeda et al. | 122/4 D |
| 4,913,068 | 4/1990 | Brannstrom | 110/245 |

OTHER PUBLICATIONS

Patent abstracts of Japan, vol. 4, No. 183, m 47, abstract of JP 55–131617, pub. 1980–10–13.

Patent abstracts of Japan, vol. 7, No. 246, m253, abstract of JP 58–133506, publ. 1983–08–09 (Kawasaki Jukogyo K.K.).

Patent abstracts of Japan, vol. 4, No. 183, m 47, abstract of JP 55–131617, publ. 1980–10–13 ( Mitsui Zosen K.K.).

*Primary Examiner*—Henry A. Bennett
*Assistant Examiner*—Siddharth Ohri
*Attorney, Agent, or Firm*—Pollock, Vande Sande & Priddy

[57] ABSTRACT

The present invention relates to a method of supplying coal and sulphur absorbent to a combustor with combustion in a fluidized bed. The coal is crushed and sorted into a fine and a coarse fraction. The fine fraction is mixed with water, possibly with oil and/or emulsifier, into a paste which is pumped into the bed of the combustor via a number of first nozzles. The coarse coal fraction is supplied to the combustor pneumatically in dry state, directly or via at least one lock hopper systems and a number of other nozzles. The invention also relates to a power plant for application of the method.

14 Claims, 1 Drawing Sheet

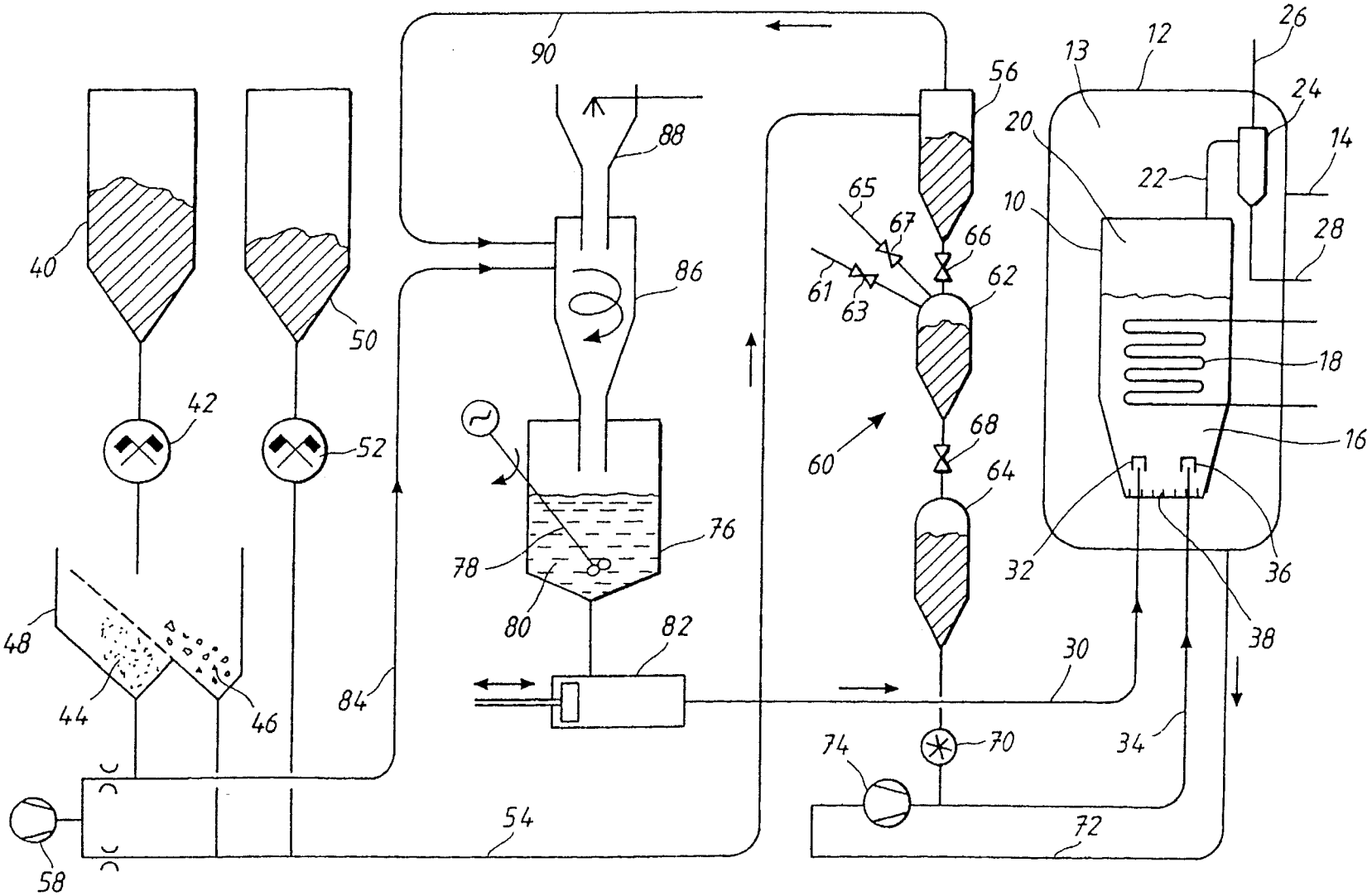
26
24
14
28
18
16
36
38
12
22
13
20
10
32
34
30
72
56
66
62
68
64
70
67
65
63
61
60
74
88
86
76
82
90
80
78
54
84
50
52
46
42
44
40
48
58

METHOD OF SUPPLYING COAL AND SULPHUR ABSORBENT TO A COMBUSTOR AND A POWER PLANT IN WHICH THE METHOD IS APPLIED

This application is a continuation of Ser. No. 07/917,069, filed as PCT/SE91/00063, Jan. 29, 1991 published as WO91/11659, Aug. 8, 1991.

TECHNICAL FIELD

The invention relates to a method of supplying coal and sulphur absorbent to a combustor with combustion in a fluidized bed of particulate material. It is primarily intended for a plant with combustion of the coal at a pressure considerably above the atmospheric pressure, that is in a PFBC plant. PFBC are the initial letters of the expression Pressurized Fluidized Bed Combustion. The invention also relates to a power plant for application of the method.

BACKGROUND OF THE INVENTION

In hitherto designed power plants of the above kind, any of the following feeding systems has been used:

a) Coal and absorbent are crushed and mixed. Of the crushed material a paste is prepared by the addition of water and possibly some emulsifying agent or oil which improves the transport properties of the paste. The past is pumped into the bed via nozzles.

This method has certain disadvantages and limitations. To obtain good transport properties of the paste, the distribution of the particle size is very important. This places heavy demands on crushing equipment and supervision of the particle size distribution. From an economic point of view, the method can only be used for high quality coal with a low sulphur content and ash content. For coal which is rich in ash and coal with a high sulphur content, which requires a high percentage of sulphur absorbent, the water content relative to the coal quantity will be high, which has a greatly negative influence on the efficiency of the plant.

b) Coal and sulphur absorbent are crushed and dried, whereupon feeding to the bed takes place via a lock hopper system.

This method is used for coal with a high ash content and/or a high sulphur content. No addition of water, which reduces the efficiency, is necessary. However, energy-demanding drying of the crushed material is required to prevent moist fine-grained material from clogging lock hopper and transport systems. Dry fine-grained pulverized coal also entails an explosion hazard which may require inert gas in the lock hopper system, which greatly increases both the investment and the operating costs.

When feeding fine-grained pulverized coal in dry state, a plurality of feeding points are required to obtain a uniform temperature distribution. These feeding points must be located near each other in the lateral direction (≦1 m between the feeding points). In addition, in order to obtain good combustion, the bed must be high (2–3 m). Otherwise there is a risk that the fine-grained coal particles blow off before they have burnt up.

If the bed is made high, also fuel nozzles must be positioned at different levels in the bed to avoid too high temperatures in the bottom zone, which would entail a risk of sintering.

As will be seen, there are considerable difficulties connected with the feeding of fine/grained coal in dry state.

c) Coal is crushed and fed as a paste. Absorbent is crushed and fed in dry state.

All coal must be crushed into a grain size suitable for the preparation of a paste. This means that the coal must be crushed into a grain size which, on average, is small and that the crushing cost will be high.

SUMMARY OF THE INVENTION

According to the present invention, coal is crushed into a maximum grain size suitable for feeding into and combustion in a fluidized bed. This crushed coal is divided into a coarse and a fine fraction. The fine fraction suitably contains coal particles smaller than about 0.5–1.0 mm and the coarse fraction contains coal particles between about 0.5–1.0 mm and about 7 mm.

This coarse coal fraction is supplied pneumatically to the combustor via a lock hopper system and nozzles, either separately or together with crushed sulphur absorbent. Because fine coal particles have been separated, the explosion hazard is eliminated in case of storage in pressurized containers and the risk of clogging of the transport devices is reduced in case of pneumatic transport. For dispensing and pressurization, a device described in Swedish patent application 8502301-8 may also be used.

Of the fine fraction, which may entail an explosion hazard, a paste is prepared by the addition of water and possibly an emulsifier or oil. Since paste is prepared only from a smaller amount of fuel, the addition of water in relation to the total fuel quantity, and hence the efficiency losses, are insignificant. Since paste is prepared only from fine-grained material, good pumpability of the paste may be obtained with a low water content since the paste is free from coarse particles which tend to sediment and cause clogging of conveying pipes.

By this invention, the need to achieve a well-balaced size distribution of the crushed material during the crushing is eliminated, the crushing is simplified and the energy consumption for the crushing of the coal is reduced, the explosion hazard is reduced, the water supply to the combustor is insignificant and hence the efficiency losses by the water supply.

Since the fine coal fraction is screened off and the lock hopper system is only supplied with the coarse coal fraction and absorbent, both the explosion hazard and the risk of clogging in the lock hopper system are reduced and more reliable feeding of fuel is obtained. Because of the reduced explosion hazard, the containers in the lock hopper system may be pressurized with air, and inert gas (which is very expensive) does not have to be used. Fuel nozzles may be placed relatively sparsely and within a limited region vertically near the air nozzles of the combustor bottom.

BRIEF DESCRIPTION OF THE DRAWING

The present invention will be described in greater detail with reference to the accompanying figure, which schematically shows the combustor and equipment for preparation and feeding of fuel and sulphur in a PFBC power plant, in which the combustion takes place at a pressure considerably exceeding the atmospheric pressure.

DETAILED DESCRIPTION OF THE PREFERRED EMBODIMENT(S)

In the figure, 10 designates a combustor which is placed inside a pressure vessel 12. The space 13 is supplied with compressed combustion air from a compressor (not shown)

via a conduit 14. The combustor 10 contains a fluidizable bed of particulate material 16, in which a fuel is burnt. The combustor 10 further accomodates tubes 18 for generation of steam for a steam turbine (not shown) and for cooling of the bed 16. Combustion gases leaving the bed 16 are collected in the freeboard 20, are conducted in the conduit 22 to a cleaning plant 24, symbolized by a cyclone 24, in which dust is separated, and from the cyclone the gases are forwarded in a conduit 26 to a gas turbine (not shown). Separated dust is discharged from the cyclone 24 via the conduit 28. Fuel paste is pumped to the combustor via the conduit 30 and the nozzles 32. A coarse fuel fraction and sulphur absorbent are supplied to the combustor 10 via the conduit 34 and the nozzles 36. The combustor 10 is supplied with air from the space 13 via nozzles 38 for fluidization of the material in the bed 16 and combustion of the supplied fuel.

Coal from a fuel storage 40 is crushed in a mill 42 and divided into a fine fraction 44 and a coarse fraction 46 in a screening plant 48. Sulphur absorbent from an absorbent storage 50 is crushed in a crusher 52. The coarse coal fraction 46 and the sulphur absorbent are transported pneumatically via the conduit 54 to a storage container 56 by means of transport gas from the compressor 58. Via a lock hopper system with the containers 62 and 64 and the valves 66 and 68 and a rotary vane feeder 70, coal and absorbent are fed to the conveying pipe 34 and further via the nozzles 36 into the bed. The transport gas consists of air which is taken from the pressure vessel 12 via the conduit 72. In the booster compressor 74 the pressure is increased. The container 62 in the lock hopper system 60 must be capable of being pressurized and pressure-relieved. For pressurization the container 62 is connected to a pressure medium source (not shown) via a conduit 61 with a valve 63. Because of the absence of fine coal particles there is no explosion hazard and the container 62 need not be pressurized with inert gas but may be pressurized with air. This means a considerable advantage and simplification of the plant. For pressure relief the container 62 is connected to a conduit 65 with a valve 67. The conduit 65 leads to a space with atmospheric pressure.

What should be considered larger and smaller particles is dependent on the type of coal and the shape the particles receive during the crushing operation. The boundary between large and small particles is set higher if the particles in the crushed material have the shape of flakes and are rich in gas than if they are more ball-shaped and poor in gas. The boundary between what should be regarded as small and large particles normally lies within the range 0.5–1.0 mm. The maximum size for large particles should usually not exceed about 7 mm.

The fine coal fraction 44 is transported to a container 76, is mixed with water and possibly other additives and is prepared while being stirred with a stirrer 78 into a pumpable fuel paste 80. This paste 80 is pumped with a paste pump 82 via the conduit 30 and the nozzles 32 to the combustor 10. The fine coal fraction 44 may be transported to the container 76 by a mechanical transport device or, as shown in the figure, by a pneumatic transport device. In the latter case, one part of the screening plant is connected to the conveying pipe 84. Propellent gas is obtained from the compressor 58. Coal and transport gas are separated in the cyclone 86 above the container 76 and fall down into this. The transport gas may be washed with water in a scrubber 88 so that dust remaining in the transport gas is removed. Transport gas for the coarse coal fraction 46 and for the absorbent may be conducted from the container 56 through the conduit 90 to the cyclone 86 and the scrubber 88 and be cleaned there.

I claim:

1. A method of supplying coal and sulphur absorbent to a combustor with combustion of coal occurring in a fluidized bed of particulate material, comprising the steps of:

a) dividing crushed coal into a fine and a coarse fraction;

b) supplying the fine coal fraction to at least one of a dust separator and a scrubber;

c) separating the fine coal fraction from the transport gas and thereafter supplying said fine fraction to a container for preparation of a paste;

d) preparing a paste of the fine fraction by the addition of a liquid while leaving the coarse fraction in a dry state;

e) pumping said paste into the fluidizing bed of the combustor through at least one first nozzle; and f) transporting the coarse coal fraction to a pressure increasing device, prior to supplying said coarse fraction to the fluidized bed; and g) supplying the coarse coal fraction and crushed absorbent to the combustor in said dry state.

2. A method of supplying coal and sulphur absorbent to a combustor with combustion of coal occurring in a fluidized bed of particulate material, comprising the steps of:

a) dividing crushed coal into a fine and a coarse fraction;

b) preparing a paste of the fine fraction by the addition of a liquid while leaving the coarse fraction in a dry state;

c) pumping said paste into the fluidizing bed of the combustor through at least one first nozzle;

d) transporting said coarse coal fraction in said dry state to a pressure increasing device prior to supplying said coarse fraction to the fluidized bed; and e) supplying the coarse coal fraction and crushed absorbent to the combustor pneumatically in said dry state.

3. A method according to claim 2 wherein said pressure increasing device comprises at least one lock-hopper device.

4. A method according to claim 2 wherein said coarse fraction is supplied to the combustor through at least one second nozzle.

5. A method according to claim 2 wherein said liquid is selected from water, oil, and a mixture of water, oil and an emulsifier.

6. A method according to claim 1 wherein said paste includes at least one of an oil and an emulsifier.

7. A method according to claim 2 wherein said coarse coal fraction and said absorbent are supplied to the combustor through a common lock-hopper system.

8. A method according to claim 2 wherein the fine coal fraction and its transport gas and dust from the transport gas for the coarse coal fraction are separated in a common dust separating device.

9. A method according to claim 3 wherein the coarse coal fraction is pneumatically transported to said lock-hopper device, the transport gas is cleaned in at least one of a cyclone and a scrubber, and wherein dust separated from the transport gas is mixed with the fine coal fraction and constitutes part of said paste.

10. In a power plant with a combustor for combustion of coal in a bed of particulate material containing a sulphur absorbent an apparatus for feeding said coal into said combustor, comprising:

a screening device for dividing crushed coal into a fine and a coarse fraction;

a transport device for transporting the fine coal fraction to a paste preparation container;

devices for mixing the fine coal fraction with a liquid for preparation of a pumpable paste;

a paste pump for pumping the paste to nozzles in the combustor;

at least one conveying pipe for transporting the coarse coal fraction and crushed sulphur absorbent to at least one pressure increasing means;

dispensing and transport devices for feeding the coarse coal fraction and the sulphur absorbent into the combustor via nozzles;

a dust separator for separation of dust from the transport gas for the fine coal fraction and from the transport gas for the coarse coal fraction; and wherein dust separated from the transport gas is mixed with the fine coal fraction and constitutes part of the prepared fuel paste.

11. A power plant with a combustor for combustion of coal in a bed of particulate material containing a sulphur absorbent and apparatus for feeding said coal into said combustor, comprising:

a screening device for dividing crushed coal into a fine and a coarse fraction;

a transport device for transporting the fine coal fraction to a paste preparation container;

devices for mixing the fine coal fraction with a liquid for preparation of a pumpable paste;

a paste pump for pumping the paste to first nozzles in the combustor;

at least one conveying pipe for transporting the coarse coal fraction and crushed sulphur absorbent to at least one pressure increasing means;

dispensing and transport devices for feeding the coarse coal fraction and the sulphur absorbent into the combustor via second nozzles;

a dust separator in which the fine coal fraction is separated from the transport gas and thereafter is supplied to said paste preparation container; and a pressure increasing device, to which the coarse coal fraction is transported before being supplied to the fluidized bed.

12. An apparatus according to claim 11 wherein said pressure increasing device is at least one lock-hopper device.

13. An apparatus according to claim 11 wherein said liquid is selected from water, oil, and a mixture of water, oil and an emulsifier.

14. An apparatus according to claim 11 wherein said paste includes at least one of an oil and an emulsifier.

* * * * *